US009979099B2

(12) United States Patent
Tonoike et al.

(10) Patent No.: US 9,979,099 B2
(45) Date of Patent: May 22, 2018

(54) TERMINAL, CRIMP TERMINAL, WIRE HARNESS, AND METHOD FOR MANUFACTURING CRIMP TERMINAL

(71) Applicants: Furukawa Electric Co., Ltd., Tokyo (JP); Furukawa Automotive Systems Inc., Shiga (JP)

(72) Inventors: Takashi Tonoike, Shiga (JP); Yukihiro Kawamura, Shiga (JP); Saburo Yagi, Tokyo (JP); Katsunori Takeda, Shiga (JP); Mikio Kuwahara, Shiga (JP)

(73) Assignees: FURUKAWA ELECTRIC CO., LTD., Tokyo (JP); FURUKAWA AUTOMOTIVE SYSTEMS INC., Shiga (JP)

( * ) Notice: Subject to any disclaimer, the term of this patent is extended or adjusted under 35 U.S.C. 154(b) by 0 days. days.

(21) Appl. No.: 14/757,876

(22) Filed: Dec. 24, 2015

(65) Prior Publication Data

US 2016/0126642 A1 May 5, 2016

Related U.S. Application Data

(63) Continuation of application No. PCT/JP2014/050857, filed on Jan. 17, 2014.

(30) Foreign Application Priority Data

Jun. 26, 2013 (JP) ..... 2013-134367

(51) Int. Cl.
*H01R 4/02* (2006.01)
*H01R 4/18* (2006.01)
(Continued)

(52) U.S. Cl.
CPC ..... *H01R 4/183* (2013.01); *H01R 13/11* (2013.01); *H01R 43/0221* (2013.01); *H01R 43/048* (2013.01)

(58) Field of Classification Search
CPC ..... H01R 4/02; H01R 4/023; H01R 4/723; H01R 4/185; H01R 4/188; H01R 43/0207; H01R 43/058
(Continued)

(56) References Cited

U.S. PATENT DOCUMENTS 4,966,565 A * 10/1990 Dohi ..... H01R 4/029 29/860
5,356,318 A * 10/1994 Fry ..... H01R 4/185 439/877
(Continued)

FOREIGN PATENT DOCUMENTS

CN 102185185 A 9/2011
CN 202444029 U 9/2012
(Continued)

OTHER PUBLICATIONS

Office Action dated Apr. 6, 2017 in a corresponding Chinese Application No. 201480001146.6.
(Continued)

*Primary Examiner* — Hien Vu
(74) *Attorney, Agent, or Firm* — Thompson Coburn LLP

(57) ABSTRACT

A crimp terminal has a crimp portion that is formed by bending a plate material into a hollow shape and that has at one end thereof an opening capable of accommodating and crimping a conductor portion of a coated wire. The crimp terminal includes a first weld portion obtained by bringing two edge portions of the crimp portion in close proximity to each other and joining by laser welding, and a second weld portion obtained by forming a lapped portion by overlapping of a transition portion formed at an opposite end of the crimp portion to the opening, and closing the lapped portion by laser welding. A welding trajectory in the second weld portion is constituted by a curve, a plurality of straight lines, or a discontinuously formed line.

11 Claims, 10 Drawing Sheets

(51) Int. Cl.
*H01R 13/11* (2006.01)
*H01R 43/02* (2006.01)
*H01R 43/048* (2006.01)

(58) Field of Classification Search
USPC ..... 439/874, 877
See application file for complete search history.

(56) References Cited

U.S. PATENT DOCUMENTS

| | | | | |
|---|---|---|---|---|
| 9,246,292 | B2 * | 1/2016 | Tachibana | H01R 43/048 |
| 9,525,215 | B2 * | 12/2016 | Kawamura | H01R 4/187 |
| 9,564,691 | B2 * | 2/2017 | Yagi | B23K 26/24 |
| 2004/0142607 | A1 | 7/2004 | Asakura et al. | |
| 2006/0057903 | A1 | 3/2006 | Asakura et al. | |
| 2011/0177727 | A1 | 7/2011 | Zhao | |

FOREIGN PATENT DOCUMENTS

| | | | |
|---|---|---|---|
| CN | 103056533 | A | 4/2013 |
| JP | 2001-250602 | A | 9/2001 |
| JP | 2004-071437 | A | 3/2004 |
| JP | 2004-192948 | A | 7/2004 |
| JP | 2006-331931 | A | 12/2006 |
| JP | 2011-233328 | A | 11/2011 |
| JP | 2013-062206 | A | 4/2013 |

OTHER PUBLICATIONS

International Search Report and Written Opinion dated Apr. 22, 2014 for PCT/JP2014/050857.
Decision to Grant a Patent dated Jun. 16, 2014 for corresponding Japanese Application No. 2014-506683.
Office Action dated Aug. 18, 2014 for corresponding Japanese Application No. 2014-104035.
Decision to Grant a Patent dated Nov. 4, 2014 for corresponding Japanese Application No. 2014-104035.
Office Action dated Feb. 27, 2015 for corresponding Korean Application No. 10-2014-7028819.
Notice of Allowance dated May 26, 2015 for corresponding Korean Application No. 10-2014-7028819.
English translation of the Written Opinion of the International Searching Authority for PCT/JP2014/050857 dated Apr. 22, 2014.
English translation of the International Preliminary Report on Patentability for PCT/JP2014/050857 dated Dec. 29, 2015.
Notification for Granting an Invention Patent dated Oct. 19, 2017 in the corresponding Chinese application No. 201480001146.6.

* cited by examiner

TERMINAL, CRIMP TERMINAL, WIRE HARNESS, AND METHOD FOR MANUFACTURING CRIMP TERMINAL

CROSS REFERENCE TO RELATED APPLICATIONS

This is a continuation application of International Patent Application No. PCT/JP2014/050857 filed Jan. 17, 2014, which claims the benefit of Japanese Patent Application No. 2013-134367, filed Jun. 26, 2013, the full contents of all of which are hereby incorporated by reference in their entirety.

BACKGROUND

Technical Field

The present disclosure relates to a terminal that can be connected to a conductor portion of a coated conductive wire, a crimp terminal, a wire harness, and a method for manufacturing the crimp terminal.

Background

In the field of electric devices, coated conductive wires such as wire harnesses are usually used. A connecting terminal is fixed to the conductor portion of such coated conductive wire for joining to another connector. In order to adequately suppress the corrosion of the conductor portion and maintain stable electric conduction, it is important to prevent ingress of moisture to the conductor portion. Since the connecting terminals used in vehicles may be exposed to moisture when the vehicles are driven in rainy weather or washed and also due to condensation, it is even more important to prevent ingress of moisture to the conductor portions of such connecting terminals. Further, aluminum electric wires using aluminum for the conductor portion have recently attracted attention as a means for improving fuel efficiency by reducing the weight of vehicles. However, where such aluminum electric wires are used together with connecting terminals formed from a dissimilar metal, a so-called electrolytic corrosion can occur in the connecting portion of the conductor portion and the connecting terminal due to the presence of water or moisture.

Accordingly, a connecting structure has been suggested in which a connecting portion is sealed with an insulator in a state in which the conductor portion of a coated conductive wire is connected to a connecting terminal in order to prevent ingress of moisture to the conductor portion (see, for example, Japanese Laid-Open Patent Publication No. 2011-233328).

In the abovementioned related art, since the cost required for sealing with an insulator is relatively high, there is still room for improvement. A different configuration can be also considered in which a crimp portion capable of accommodating and crimping the conductor portion of a coated conductive wire is formed by bending a plate material, and the conductor portion is surrounded thereby.

A technique to be used with such a configuration has been suggested in which a terminal having a hollow (tubular) crimp portion closed at one end is used, an end portion of an electric wire is inserted into the crimp portion, and the crimp portion is then crimped by swaging to protect the end portion of a core wire from adhesion of rainwater or seawater (see, for example, Japanese Laid-Open Patent Publication No. 2006-331931 and Japanese Laid-Open Patent Publication No. 2001-250602).

The inventors have also suggested a technique relating to a crimp terminal ST which is a terminal having a hollow (tubular) crimp portion closed at one end, the terminal being obtained, as shown in FIG. 13, by forming a tubular crimp portion Ta and a box-shaped connector portion Tb by punching and bending a plate strip material and then forming a transition portion Td by squeezing the connecting portion of the crimp portion Ta and the connector portion Tb.

In such a crimp terminal ST, a sealed structure is formed by laser welding a butted interface Tc and a lapped portion Td, which appear in the portion bent into a hollow shape, in the crimp portion Ta and the transition portion Td. More specifically, firstly, the butted interface Tc formed along the axial direction is laser welded in the upper end portion of the crimp portion Ta that has been bent into a cylindrical shape in the crimp terminal ST. Then, the transition portion Td is formed, and the lapped portion Te of the transition portion Td is also laser welded and sealed in order to suppress the ingress of water to the conductor portion.

In the above-described related art, laser welding is performed on the lapped portion Te at which plate materials are closely attached to each other by squeezing the transition portion Td. Since the laser welding is performed along a straight line in the terminal width direction, the strength of the transition portion Td can be thereby decreased. That is, the welding line may become a break line and the transition portion Td may break along the trajectory of laser welding in the transition portion Td.

The present disclosure is related to providing a terminal, a crimp terminal, a wire harness, and a method for manufacturing the crimp terminal such that ingress of moisture to the conductor portion of a coated conductive wire is adequately suppressed while preventing local decrease in strength and deformation.

SUMMARY

According to an aspect of the disclosure, a crimp terminal provided with a crimp portion that is formed by bending a plate material into a hollow shape and that has at one end thereof an opening capable of accommodating and crimping a conductor portion of a coated wire is provided. The crimp terminal includes a first weld portion obtained by bringing two edge portions of the crimp portion in close proximity to each other and joining by laser welding, and a second weld portion obtained by forming a lapped portion by overlapping of a transition portion formed at an opposite end of the crimp portion to the opening, and closing the lapped portion by laser welding. A welding trajectory in the second weld portion is constituted by a curve, a plurality of straight lines, or a discontinuously formed line.

The crimp terminal according to an aspect of the disclosure may also be regarded as a wire harness provided with the aforementioned crimp terminal, the wire harness including: a coated wire in which a conductor portion is exposed at an end from an insulating coating; and a crimp terminal provided with a crimp portion that is formed by bending a plate material into a hollow shape and that has at one end an opening capable of accommodating and crimping the conductor portion of the coated wire, the wire harness further including: a first weld portion obtained by bringing two edge portions of the crimp portion in close proximity to each other and joining by laser welding; and a second weld portion obtained by forming a lapped portion by overlapping of a transition portion formed at an opposite end of the crimp portion to the opening, and closing the lapped portion by laser welding, a welding trajectory in the second weld portion being constituted by a curve, a plurality of straight lines, or a discontinuously formed line.

The crimp terminal according to an aspect of the disclosure may also be considered as a method for manufacturing the aforementioned crimp terminal, the method including: performing a primary processing including applying a punching process on a plate material constituted by a metal base material to form a crimp terminal in a spread-out state; performing a secondary processing including bending the crimp terminal in the spread-out state into a hollow shape by a bending process to form at least a crimp portion that has at one end an opening capable of accommodating and crimping a conductor portion of a coated wire and a transition portion at an opposite end of the crimp portion to the opening; performing a first welding including bringing two edge portions of the crimp portion in close proximity to each other and joining by laser welding; and performing a second welding including lapping and closing the transition portion and joining by laser welding, a welding trajectory in the second weld portion being constituted by a curve, a plurality of straight lines, or a discontinuously formed line.

The welding trajectory formed by the curve includes a U-shape. The welding trajectory formed by the plurality of straight lines includes a V-shape.

In the above-described present disclosure, by forming the welding trajectory in the lapped portion of the terminal or crimp terminal, for example, by a U-shaped curve, a plurality of straight lines in a V-shape, or a discontinuously formed line, it is possible to disperse a load, which is applied to the lapped portion, in the axial direction of the crimp terminal. Therefore, the strength of the crimp terminal can be prevented from decreasing locally and ingress of moisture to the conductor portion of the coated conductive wire can be prevented more adequately as compared to a case where the welding trajectory is formed on a straight line in the left-right direction with respect to the axial direction of the terminal.

In the preferred embodiment of the present disclosure, the welding trajectory is formed at a predetermined distance from the left and right end portions with respect to an axial direction of the lapped portion.

In such an embodiment, in the lapped portion, the left and right end portions with respect to the axial direction serve as thick portions of the base material that forms the crimp terminal, and a wall portion is formed. This wall portion is not required to be sealed by welding. Therefore, even though the laser welding is implemented outside the thick portions at the left and right end portions, no adverse effect is produced on the hermeticity, whereas since the welding range is narrowed, the decrease in strength caused by laser welding in the transition portion can be prevented.

In the preferred embodiment of the present disclosure, a boundary with the transition portion in the crimp portion is formed along a shape of the welding trajectory.

In such an embodiment, by shaping the boundary of the crimp portion and the transition portion to match the welding trajectory, it is possible to provide a terminal of simple external appearance while ensuring the hermeticity of the crimp terminal.

In the preferred embodiment of the present disclosure, the transition portion is provided with a lapped portion in which portions of the plate material in close contact with each other that is formed along a shape of the welding trajectory are, and a hollow portion in which the portions of the plate material are not in close contact with each other.

In such an embodiment, since the lapped portion, which has been squeezed by bending processing, is within an extent corresponding to the laser welding range, it is possible to reduce the lapping range of the plate material, and also provide a hollow portion between the bent plate materials, thereby making it possible to increase the strength of this portion.

In the preferred embodiment of the present disclosure, there is provided a connector portion serving as a connecting terminal, wherein the crimp portion and the connector portion are connected by the transition portion; at a connecting portion between the connector portion and the transition portion, a folding back portion is formed at which the plate material changes from a state in which the plate material stands vertically to a state in which two edge portions of the plate material are brought in close proximity to each other, in order to form the first weld portion by bending the plate material; and the folding back portion is formed in such a manner that the edge portion of the plate material has a gradual inclination from an outer side to an inner side from the connector portion side toward the end portion of the first weld portion.

In such an embodiment, by providing the folding back portion at which the plate material changes from a state in which the plate material stands vertically to a state in which two edge portions of the plate material are brought in close proximity to each other, between the lapped portion and the connector portion, it is possible to increase the strength of the transition portion and prevent cracking in this portion.

In the preferred embodiment of the present disclosure, on left and right end portion sides with respect to the axial direction of the lapped portion, the welding trajectory in the second weld portion is formed from positions at a distance equal to a thickness of the plate material. In such an embodiment, since the welding is started from such positions, a decrease in strength can be suppressed since the end portions are not welded. Further, since the welding is performed from the inner side obtained by bending the plate substantially through 180°, waterproofing can be also ensured.

In the preferred embodiment of the present disclosure, the welding trajectory in the second weld portion is a trajectory of welding performed by irradiating a lapped portion with a laser beam from the opening portion of the crimp portion. In such an embodiment, the decrease in strength can be suppressed by comparison with the case of welding the surface of the lapped portion in which through welding can occur.

The above-described present disclosure can provide a terminal, a crimp terminal, a wire harness, and a method for manufacturing the crimp terminal such that ingress of moisture to the conductor portion of a coated conductive wire is adequately suppressed while preventing local decrease in strength and deformation.

DETAILED DESCRIPTION

Hereinafter, embodiments of the present disclosure will be specifically described with reference to FIGS. 1 to 9.

1. Overview of Crimp Terminal and Wire Harness of the Present Embodiment (Materials for Crimp Terminal)

First, an overview of a crimp terminal and a wire harness of the present embodiment will be described. The wire harness of the present embodiment is used by exposing a core wire portion from an insulating resin in a coated wire in which an aluminum core wire constituted by a bundle of aluminum wires is covered with the insulating resin, and then crimping and connecting a crimp terminal.

For example, an aluminum core wire composed of iron (Fe) at about 0.2% by mass, copper (Cu) at about 0.2% by mass, magnesium (Mg) at about 0.1% by mass, silicon (Si) at about 0.04% by mass, with the balance being aluminum (Al) and incidental impurities, can be used as the core wire for the aluminum electric wire. Other suitable alloy compositions include a composition composed of Fe at about 1.05% by mass, Mg at about 0.15% by mass, Si at about 0.04% by mass, with the balance being Al and incidental impurities; a composition composed of Fe at about 1.0% by mass and Si at about 0.04% by mass, with the balance being Al and incidental impurities; and a composition composed of Fe at about 0.2% by mass, Mg at about 0.7% by mass, Si at about 0.7% by mass, with the balance being Al and incidental impurities. Those alloys may additionally contain alloying elements such as Ti, Zr, Sn, and Mn. By using such an aluminum core wire, it is possible to obtain a twisted core wire including 7 to 19 wires with 0.5 sq ($mm^2$) to 2.5 sq ($mm^2$). A coating material including a polyolefin, such as PE and PP, as the main component or PVC as the main component can be used as a coating material for the core wire.

(Process for Manufacturing Crimp Terminal)

An outline of a manufacturing process for manufacturing a crimp terminal to be used in the wire harness of the present embodiment will be explained below with reference to FIGS. 8A to 8D. As shown in FIGS. 8A to 8D, the crimp terminal of the present embodiment is formed from a plate strip CS (FIG. 8A) unwound from a roll. Thus, a chained terminal T1 shown in FIG. 8B is formed from the plate strip CS shown in FIG. 8A by performing punching as primary pressing. In the chained terminal T1, carrier portions C1 and C2 for carrying the chained terminal T1 in a conveying direction are formed in a press (not shown in the figure), and a plurality (in this case, one for each position of the individual crimp terminal T) of perforations H for inserting pins for performing alignment during conveying is provided with a predetermined pitch L at the carrier portion C2. A portion constituting a hollow crimp portion Ta of the individual crimp terminal T in the subsequent steps and a box-shaped connector portion Tb serving as a connecting portion with another terminal are formed between the carrier portions C1 and C2.

Figure 8A:
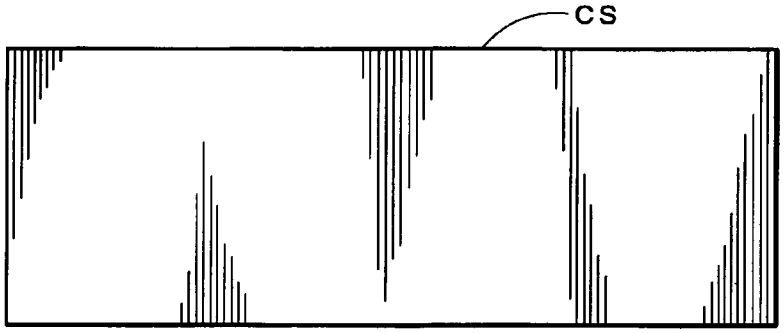
FIGS. 8A to 8D are schematic diagrams showing a process for manufacturing a crimp terminal according to an embodiment of the present disclosure.
Figure 8B:
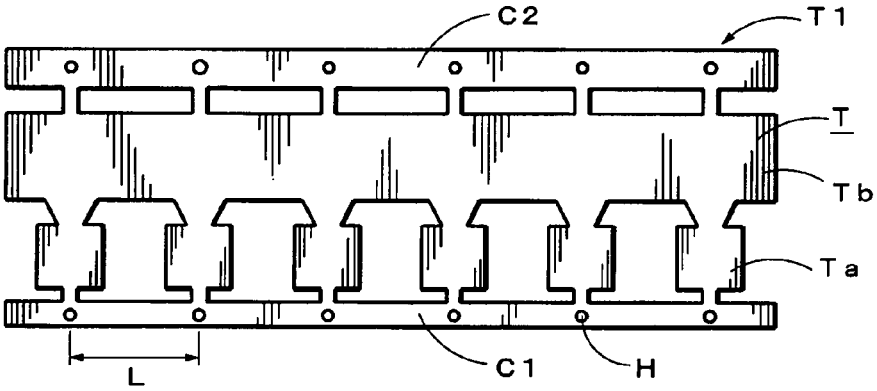
Figure 8C:
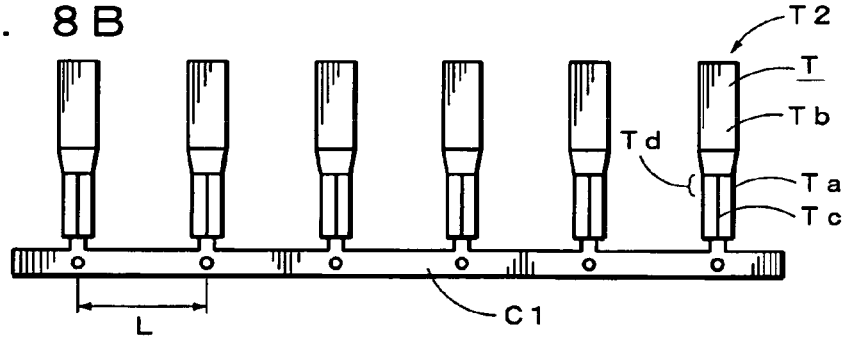

A chained terminal T2 shown in FIG. 8C is formed by performing bending as secondary pressing illustrated by FIG. 8C. In the chained terminal T2, the carrier portion C2 is removed, and only the carrier portion C1 is present. The crimp portions Ta and the connector portions Tb are respectively formed into a hollow (tubular) shape and a box-shape by bending. In this state, a butted interface Tc appearing in a hollow bent portion is formed in the crimp portion Ta.

Figure 8D:
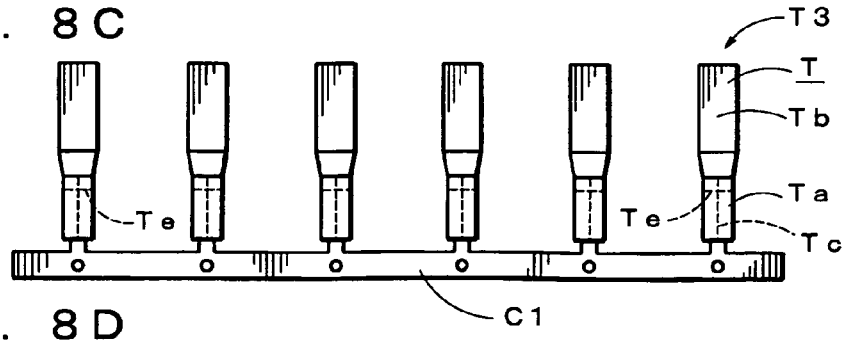

The butted interface Tc is joined by laser welding to obtain a closed structure of the crimp portion Ta. More specifically, initially, the butted interface Tc formed in the axial direction at the upper end portion of the crimp portion Ta that has been bent into a cylindrical shape in the crimp terminal T is laser welded. Then, the connecting portion with the connector portion Tb is squeezed to form a transition portion Td, and the lapped portion Te of the transition portion Td is also laser welded and sealed to prevent ingress of water to the conductor portion. By the above-described operations, as shown in FIG. 8D, a chained terminal T3 is manufactured in which the crimp terminals T before the electric wires are being inserted are held by the carrier portion C1.

In this case, an example is used in which the bent portions of the crimp terminal T are butted, but joining by laser welding can be also performed when the bent portions overlap.

(Basic Configuration of Crimp Terminal)

Figure 1:
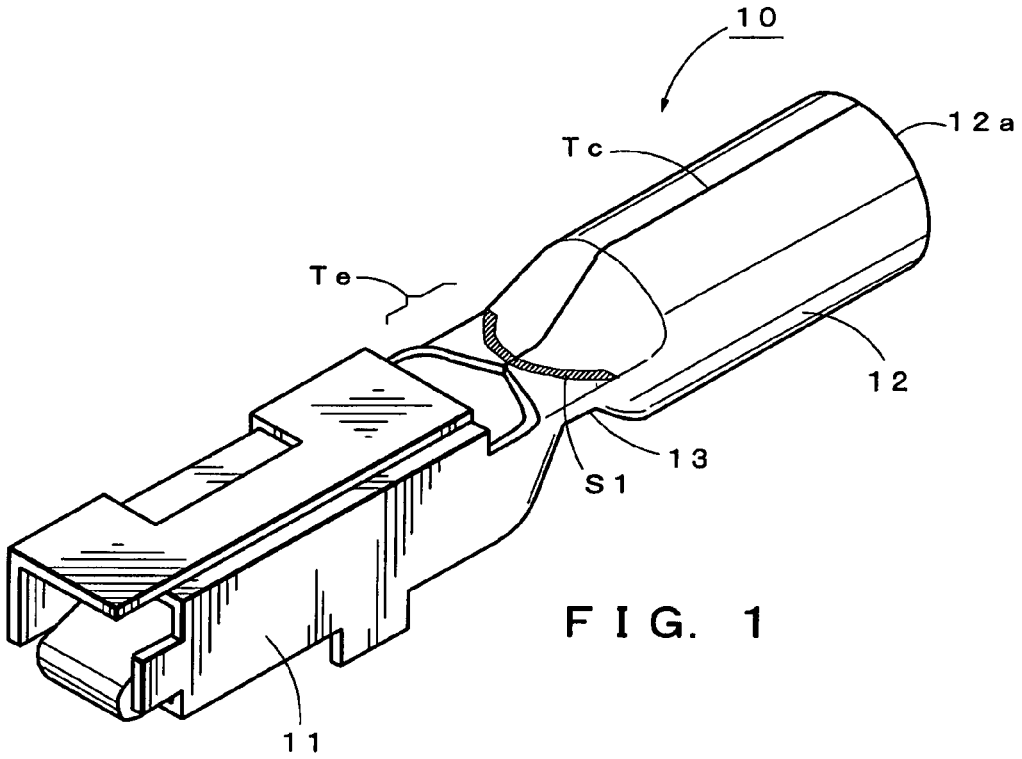
FIG. 1 is a perspective view of a crimp terminal according to an embodiment of the present disclosure.

The basic configuration of the crimp terminal for use in the wire harness of the present embodiment will be explained below with reference to FIG. 1. As shown in FIG. 1, a crimp terminal 10 includes a box-shaped connector portion 11, a hollow crimp portion 12 that is closed at one end and positioned on the rear side in the figure (right side in FIG. 1) of the connector portion 11, and a flat transition portion 13 connecting the connector portion 11 and the crimp portion 12 which are formed integrally.

The crimp terminal 10 is formed from a base, material basically constituted by a metal material (copper, aluminum, steel or alloys including them as the main components) to ensure electric conductivity and strength. In order to ensure various properties required for a crimp terminal, for example, an entirety of or a part of the crimp terminal 10 may be plated with tin or silver.

In the present embodiment, an example is shown in which the connector portion 11 is a female terminal into which an insertion tab (not shown in the figure) as represented by a male terminal is to be inserted, but in the present disclosure, the shape of the detailed portion of the connector portion 11 is not particularly limited. Thus, in another embodiment, for example, an insertion tab of a male terminal can be provided and formed instead of the female connector portion 11.

The crimp portion 12 is a part of the crimp terminal 10 where an end portion of a covered electric wire is crimped and joined, as mentioned hereinabove. The crimp portion 12 has an opening portion 12*a* (insertion opening) for inserting the end portion of an electric wire (not shown in the figure) at one end (right rear side in FIG. 1) in the longitudinal direction, and the other end (left front side in FIG. 1) in the longitudinal direction is connected to the transition portion 13 and closed.

More specifically, as shown in FIGS. 8A to 8C, the punched plate strip CS is bent into a hollow shape to bring the two edge portions in close proximity to each other and a butted interface Tc is formed. The connecting portion with the connector portion 11 is squeezed to form the transition portion 13 and closed as the lapped portion Te. The butted interface Tc and the lapped portion Te are then laser welded and sealed.

The reason why the crimp portion 12 is configured as described above to surround the entire circumference of the insulating coating of an electric wire in a closed manner so as to prevent moisture or the like from entering from the outside is that, since in a case where moisture adheres to a contact of the metal material (copper, aluminum, steel, and the like) of the crimp terminal 10 and the aluminum electric wire, one of the metals (alloys) is corroded due to a difference in electrode potentials of the two metals.

Even when the crimp terminal 10 and the core wire of the electric wire are both made of aluminum, corrosion can still occur in the joined portion thereof due to a small difference in alloy composition. In the present disclosure, since the crimp portion 12 can achieve a certain anticorrosive effect as long as it surrounds the entire circumference of the insulating coating of the electric wire in a closely contacted state, the crimp portion 12 is not necessarily required to have a cylindrical shape and may be in the form of an elliptical or rectangular tube. It is also not required that the crimp portion 12 have a constant diameter, and the diameter may vary in the longitudinal direction. However, as will be indicated hereinbelow, it is preferred that the crimp portion 12 have a shape such that the inner surface thereof could come into a sufficiently close contact with the surface of the insulating coating of the electric wire at the time of crimping.

2. Specific Embodiments

Specific embodiments of the crimp terminal to be used in the wire harness according to an embodiment of the present disclosure will be explained below with reference to FIGS. 1 to 7. As shown in FIG. 1, the crimp terminal 10 of the present embodiment is characterized by a welding trajectory in the lapped portion Te formed in the transition portion 13 in a case where laser welding is performed. Thus, the welding trajectory of laser welding in the lapped portion Te of the crimp terminal 10 of the present embodiment is constituted by a curve, a plurality of straight lines, or a discontinuously formed line. A plurality of patterns of the welding trajectory will be explained below with reference to the drawings.

First Embodiment—Curve

As shown in FIG. 1, a welding trajectory S1 in the lapped portion Te in the crimp terminal 10 is constituted by a U-shaped curve. In this case, a convex part of the U-shaped curve may be formed to be oriented towards the side opposite that of the opening portion 12*a*, that is, to face the connector portion 11 side, or as shown in FIG. 3A, a convex part of the curve may be formed to be oriented towards the opening portion 12*a* side, that is, the side opposite that of the connector portion 11 side.

Figures 3A, 3B, 3C:
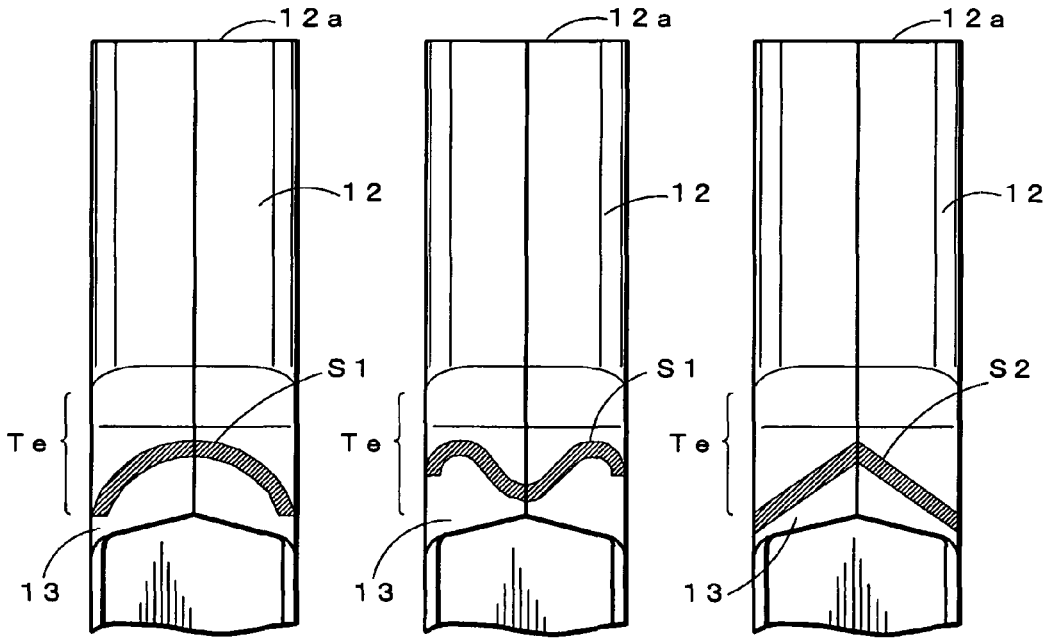
FIGS. 3A to 3F are schematic diagrams showing a plurality of welding patterns of a crimp terminal according to an embodiment of the present disclosure.

Further, forming the welding trajectory S1 by a curve also includes forming the welding trajectory S1 by a wave-like curve, as shown in FIG. 3B, that is, a curve in which a plurality of convex parts are formed, or a curve in which a plurality of inflection points are formed.

Second Embodiment—Plurality of Straight Lines

Figure 2:
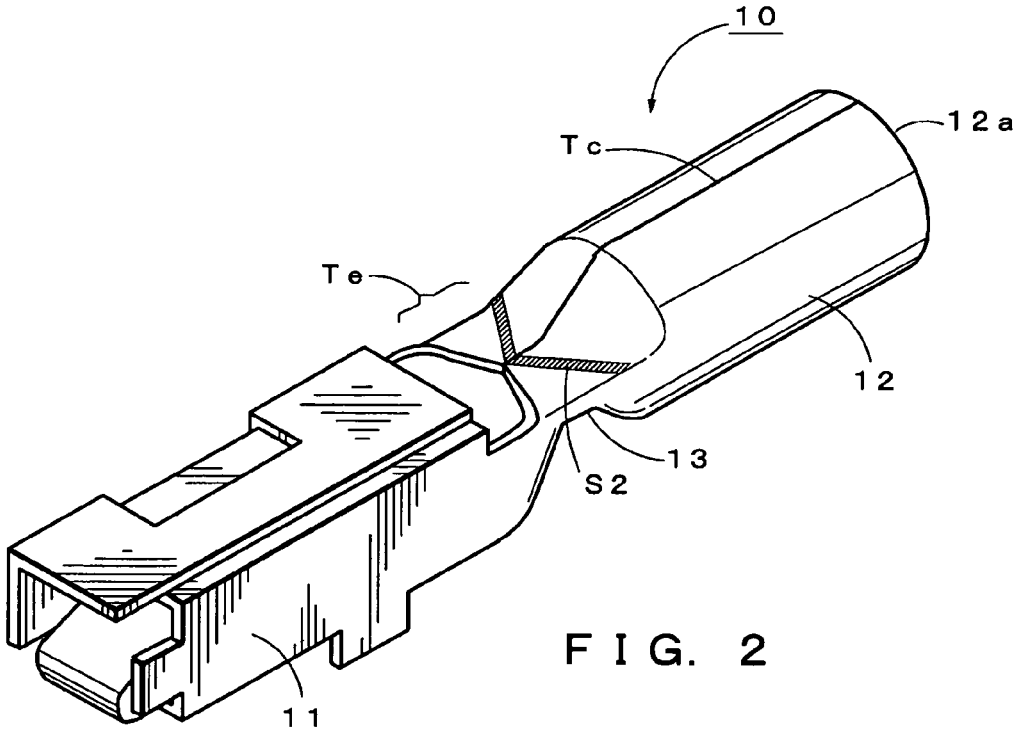
FIG. 2 is a perspective view of a crimp terminal according to an embodiment of the present disclosure.

As shown in FIG. 2, the welding trajectory S2 in the lapped portion Te in the crimp terminal 10 is constituted by a plurality of lines forming a V-shape. In this case, as shown in FIG. 2, the welding trajectory S2 is formed by two straight lines forming a V-shape such that the apex is oriented towards the side opposite that of the opening portion 12*a*, that is, oriented towards the connector portion 11 side, from the left and right end portions with respect to the axial direction of the crimp terminal 10.

In a case where the apex of the V shape in the welding trajectory S2 matches the end of the connector side 11 of the lapped portion Te, it can be a starting point of breakage, and thus, it is preferred that the apex is provided at a distant. In other words, since the point where the plate material changes from two plates into one plate and the point where physical properties of the terminal base material are changed by welding can overlap and become a starting point of breakage, possibility of breakage can be reduced by providing the V shape apex in the welding trajectory S2 at a distance.

FIGS. 3C to 3F show other embodiments in which the welding trajectory S2 is constituted by a plurality of straight lines. FIG. 3C shows an embodiment in which the apex of the V shape of the embodiment shown in FIG. 2 is formed to be oriented towards the opposite direction. That is, the welding trajectory S2 is formed by two straight lines forming a V-shape such that the apex is oriented towards the opening portion 12*a* side, that is, oriented towards the side opposite that of the connector portion 11, from the left and right end portions with respect to the axial direction of the crimp terminal 10.

Figures 3D, 3E, 3F:
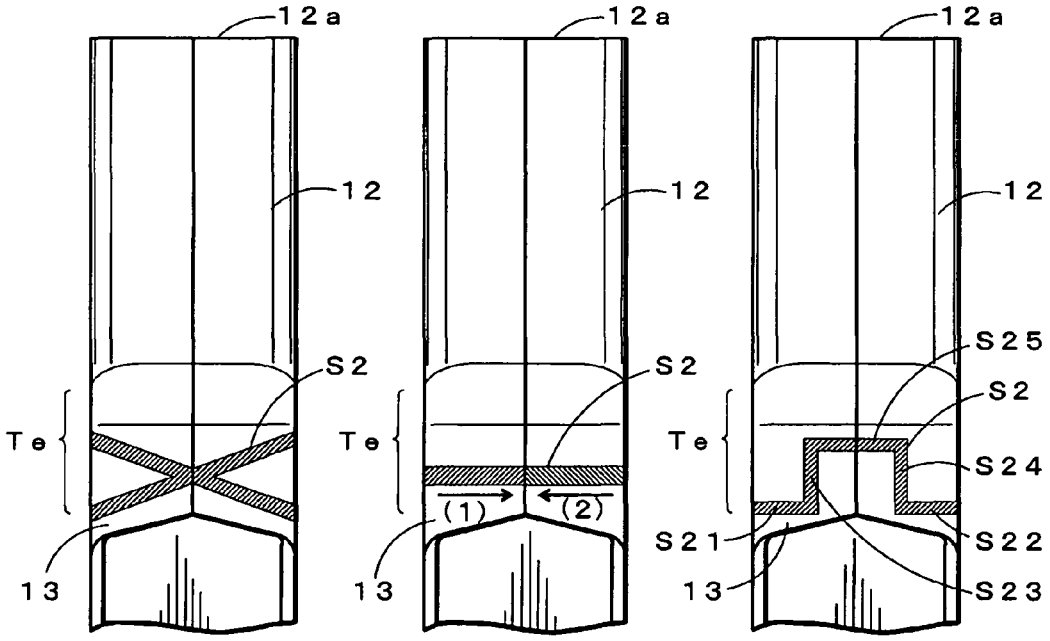

FIG. 3D shows an embodiment in which the welding trajectory S2 is formed in an X shape in the lapped portion Te by two straight lines from the left and right end portions with respect to the axial direction of the crimp terminal 10.

FIG. 3E shows an embodiment in which the welding trajectory S2 is obtained by sweeping a laser beam twice from the left and right end portions toward the butted portion Tc, as shown by arrows accompanied by numerals in the figure, this trajectory being substantially formed by two welding trajectories S2.

Further, FIG. 3F shows an embodiment in which the welding trajectory S2 is constituted by a total of five straight lines, namely, trajectories S21 and S22 swept from the left and right end portions with respect to the axial direction of the crimp terminal 10, in directions perpendicular to the axial direction, trajectories S23 and S24 protruding in the axial direction from distal ends of the trajectories S21 and S22, and a trajectory S25 formed in the direction perpendicular to the axial direction so as to connect distal ends of the trajectories S23 and S24. Thus, in this embodiment, a convex part that projects toward the opening portion 12*a* side is formed in the central portion of the welding trajectory S2. The projection direction of the convex part is not limited to the one toward the opening portion 12*a* side, which is shown in FIG. 3F, and also includes the one that projects in the opposite direction to the opening portion 12*a*, that is, toward the connector portion 11 side.

Third Embodiment: Discontinuously Formed Line

Figure 4A:
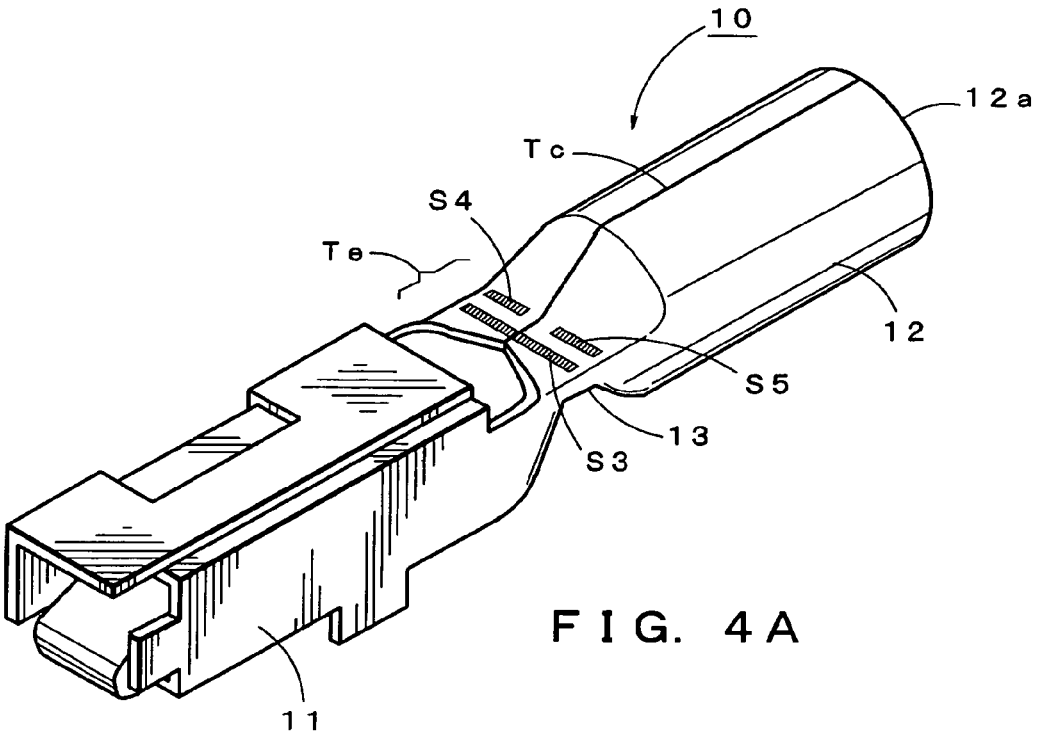
FIG. 4A is a perspective view of a crimp terminal according to an embodiment of the present disclosure.
Figure 4B:
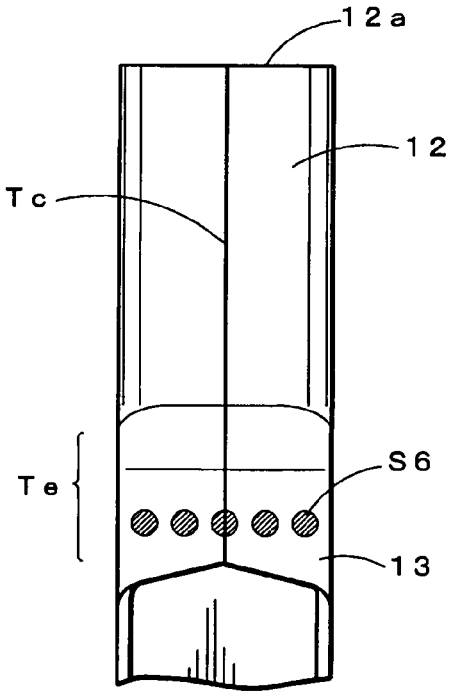
FIG. 4B is a schematic diagram thereof.

The third embodiment is shown in FIG. 4A or FIG. 4B. The embodiments shown in FIGS. 2 and 3C to 3E represent examples in which a plurality of straight lines is formed continuously, but in the example represented by the third embodiment, as shown in FIG. 4A or 4B, a plurality of lines are formed discontinuously. In other words, the lines are formed at a distance from each other.

More specifically, as shown in FIG. 4A, a welding trajectory S3 is formed in a straight line from the left and right end portions in the axial direction of the crimp terminal 10 in the lapped portion Te in the same manner as in the related art, and then two split straight lines are formed as welding trajectories S4 and S5 in the left-right direction with respect to the axial direction of the crimp terminal 10 at a location shifted in the axial direction.

The positional relationship among the welding trajectory S3, which is formed continuously in the left-right direction, and the two split welding trajectories S4 and S5 in the axial direction of the crimp terminal 10 may be also reversed with respect to that shown in FIG. 4A. In other words, in FIG. 4A, as mentioned hereinabove, the welding trajectory S3 is provided at the connector portion 11 side and the welding trajectories S4 and S5 are provided at the opening portion 12*a* side, but the welding trajectory S3 may be provided at the opening portion 12*a* side, and the welding trajectories S4 and S5 may be provided at the connector portion 11 side.

As another embodiment of a discontinuously formed line, as shown in FIG. 4B, a welding trajectory S6 can be in the form of a broken line or dots in the left-right direction with respect to the axial direction of the crimp terminal 10. In this case, the broken line or dots can be formed by pulsed laser irradiation with a laser welding apparatus.

Operation Effect of First to Third Embodiments

The operation effect of the crimp terminals of the above-described first to third embodiments is explained below.

The welding trajectory S1 and S2 of the crimp terminal 10 are formed by a curve or a plurality of straight lines. As a result, a load, which is applied to the lapped portion Te, can be dispersed in the axial direction of the crimp terminal. Therefore, the welding trajectory can be prevented from becoming a breakage line and the transition portion can be prevented from being broken, as in the case of the related art in which a welding trajectory is formed as a single straight line in the left-right direction with respect to the axial direction of the crimp terminal.

More specifically, as a result of forming the welding trajectory S1 in the lapped portion Te by a U-shaped curve, as shown in FIG. 1, a portion which is affected by heat during welding of the transition portion 13 can be arranged uniformly in the axial direction of the crimp terminal 10. Therefore, the strength of the crimp terminal is prevented from being decreased locally and the conductor portion of the coated conductive wire can be more reliably waterproofed as compared to a case of the related art in which the welding trajectory is formed on a straight line in the left-right direction with respect to the axial direction of the terminal.

Further, by forming the welding trajectory S2 in a V-shape, as shown in FIG. 2, it is possible to disperse the welding trajectory in the axial direction of the crimp terminal. Therefore, the strength of the crimp terminal can be better prevented from decreasing locally and the ingress of moisture to the conductor portion of the coated conductive wire can be prevented more adequately than when the welding trajectory is formed on a straight line in the left-right direction with respect to the axial direction of the terminal.

In the pattern shown in FIGS. 3A to 3D and 3F, by forming the welding trajectory by a curve or a plurality of straight lines, it is possible to expand the range of the welding trajectory in the axial direction of the crimp terminal and disperse the load relating to the lapped portion in the axial direction of the crimp terminal. Therefore, the strength of the crimp terminal can be prevented from decreasing locally and the ingress of moisture to the conductor portion of the coated conductive wire can be prevented more adequately than when the welding trajectory is formed on a straight line in the left-right direction with respect to the axial direction of the terminal.

In the embodiment shown in FIG. 3E, the welding trajectory is formed substantially by two welding trajectories S2 produced by sweeping the laser beam twice from the left and right end portions toward the butted portion Tc at the center. As a result, the lapped portion Te is prevented from being affected by heat, and formation of low-strength portions locally in the transition portion 13 is suppressed. In other words, since laser is swept from the left and right end portions, rather than swept continuously, a thermal effect on the lapped portion Te becomes discontinuous, and the a effect of the laser beam swept from one end to the center is separated in time from the thermal effect of the laser beam swept from the other end to the center. As a result, a thermal effect on the lapped portion Te can be suppressed.

With the above-described embodiments, it is possible to provide a crimp terminal 10 in which ingress of moisture to the conductor portion of the coated conductive wire is adequately suppressed, while suppressing a decrease in the strength and deformation of the crimp terminal 10.

Fourth Embodiment: Modification of Sealing Shape (1)

Figure 5A:
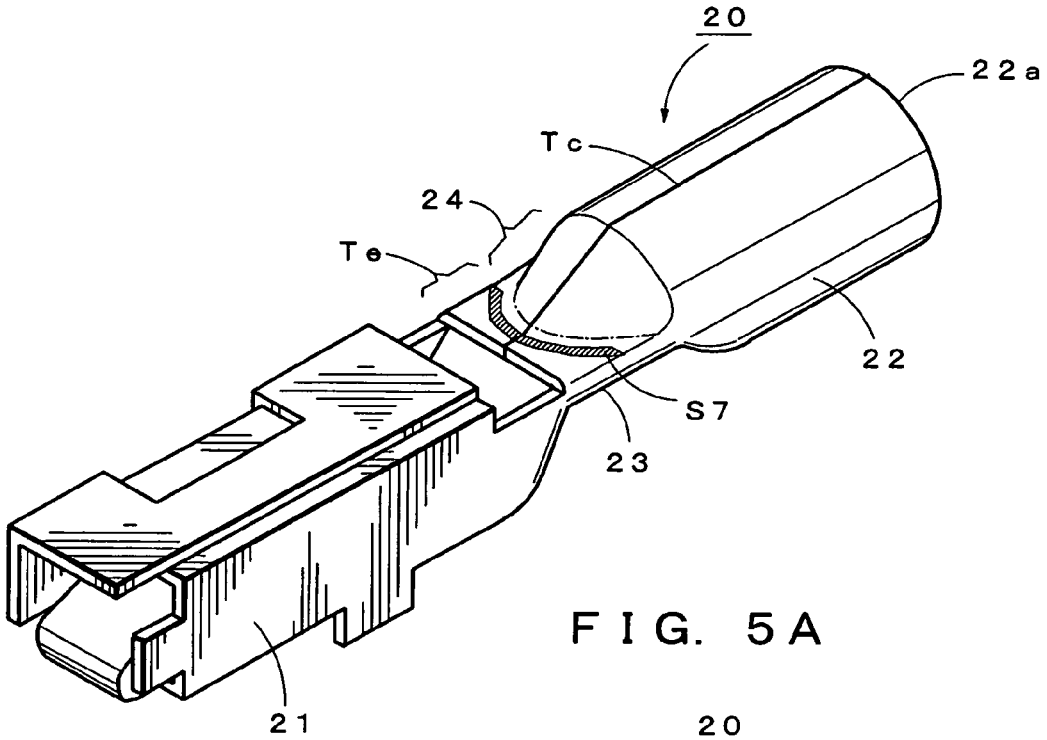
FIG. 5A and FIG. 5B are perspective views of a crimp terminal according to an embodiment of the present disclosure.
Figure 5B:
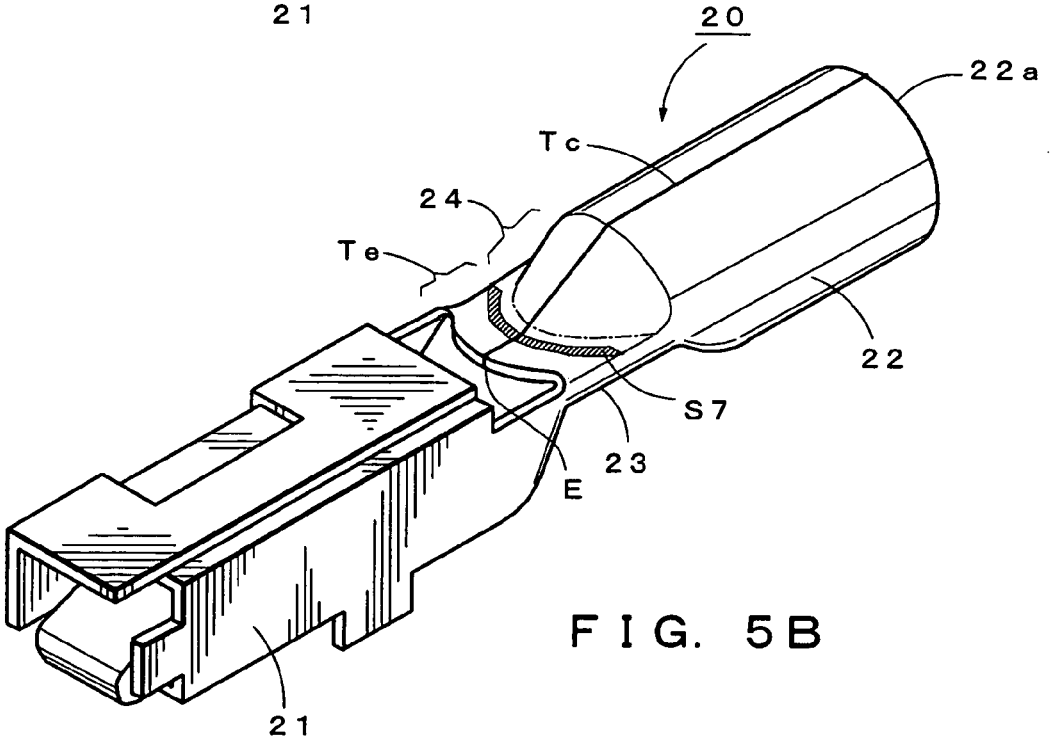
Figure 6:
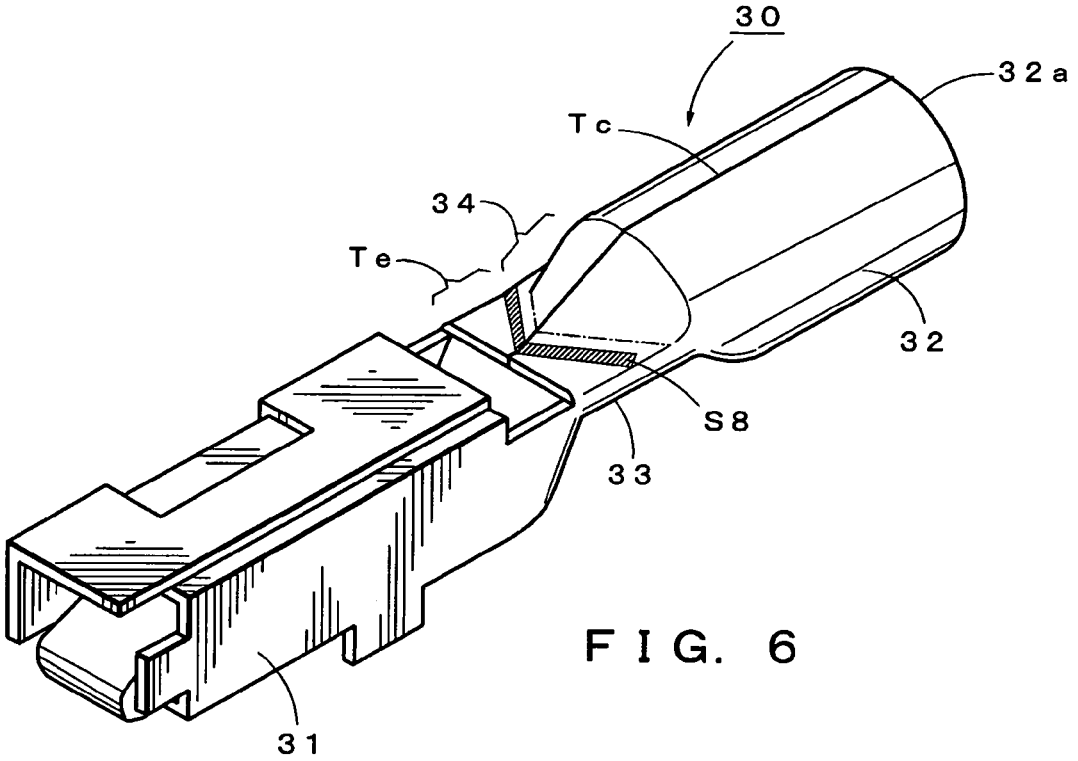
FIG. 6 is a perspective view of a crimp terminal according to an embodiment of the present disclosure.

In the fourth embodiment, the shape of the inclined portion corresponding to a boundary between the crimp portion and transition portion of the crimp terminal is changed, as shown in FIGS. 5A, 5B and 6, as a modification of the crimp terminal 10 in which the welding trajectory shown in FIG. 1 or FIG. 2 is constituted by a curve or a plurality of continuous straight lines.

In the configurations shown in FIGS. 5A and 5B, a welding trajectory S7 is constituted by a curve having a convex part oriented toward a connector portion 21 side, in the same manner as shown in FIG. 1, but in a crimp terminal 20, a transition portion 23 is formed by squeezing a crimp portion 22 such that the rising portion of an inclined portion 24, which corresponds to the boundary between the crimp portion 22 and the transition portion 23, has a curved shape matching the sweeping shape of the welding trajectory S7, as shown by a broken line in the figure. FIG. 5B shows an example in which the shape of the butted interface Tc corresponding to the boundary between the transition portion 23 and the connector portion 21, on the end portion E side, is formed as a curve matching the shape of the welding trajectory S7. In the configuration shown in FIG. 6, a welding trajectory S8 is formed in a V-shape having an apex on the connector portion 31 side, as in FIG. 2, but in a crimp terminal 30, a transition portion 33 is formed by squeezing a crimp portion 32 such that the rising portion of an inclined portion 34, which corresponds to the boundary between the crimp portion 32 and the transition portion 33, has a V-shape matching the sweeping shape of the welding trajectory S8, as shown by a broken line in the figure.

The embodiments shown in FIGS. 5A, 5B and 6 also include embodiments, in which, as mentioned in the explanation relating to the embodiments shown in FIGS. 1 and 2, the orientation of the convex part of the curve of the welding trajectory S7 and the orientation of the apex of the V-shape of the welding trajectory S8 are reversed, that is, the convex part of the curve faces an opening portion 22*a* and the apex of the V-shaped faces an opening portion 32*a*. In this case, a transition portion is formed by squeezing a crimp portion such that the rising portion of an inclined portion, which corresponds to the boundary between the crimp portion and the transition portion, has a shape matching the sweeping shape of the welding trajectory.

With the above-described crimp terminals 20 and 30 of the fourth embodiment, the welding trajectory in the lapped portion Te is constituted by a curve or a plurality of straight lines. As a result, the welding trajectory can be dispersed in the axial direction of the crimp terminal in the same manner as in the first to third embodiments. Therefore, the strength of the crimp terminal can be better prevented from decreasing locally and the ingress of moisture to the conductor portion of the coated conductive wire can be prevented more adequately than when the welding trajectory is formed on a straight line in the left-right direction with respect to the axial direction of the terminal.

As the size of the terminal decreases, a space for dispersing the welding trajectory in the axial direction of the crimp terminal becomes more difficult to ensure. However, with the crimp terminal 20 or 30 of the fourth embodiment, the lapped portion Te can be also formed on the electric wire insertion opening (opening portions 22*a* and 32*a*) side. In other words, by providing the welding start point and end point on the electric wire insertion opening (opening portions 22*a* and 32*a*) side, it is possible to reduce the terminal in size while ensuring a space for accommodating the electric wire core.

Further, in the crimp terminal 20 or 30 of the present embodiment, by shaping the boundary of the crimp portions 22 and 32 and the transition portions 23, 33 to match a welding trajectory, it is possible to provide a terminal of simple external appearance while ensuring the hermeticity of the crimp terminal.

Fifth Embodiment: Modification of Sealing Shape (2)

Figure 7:
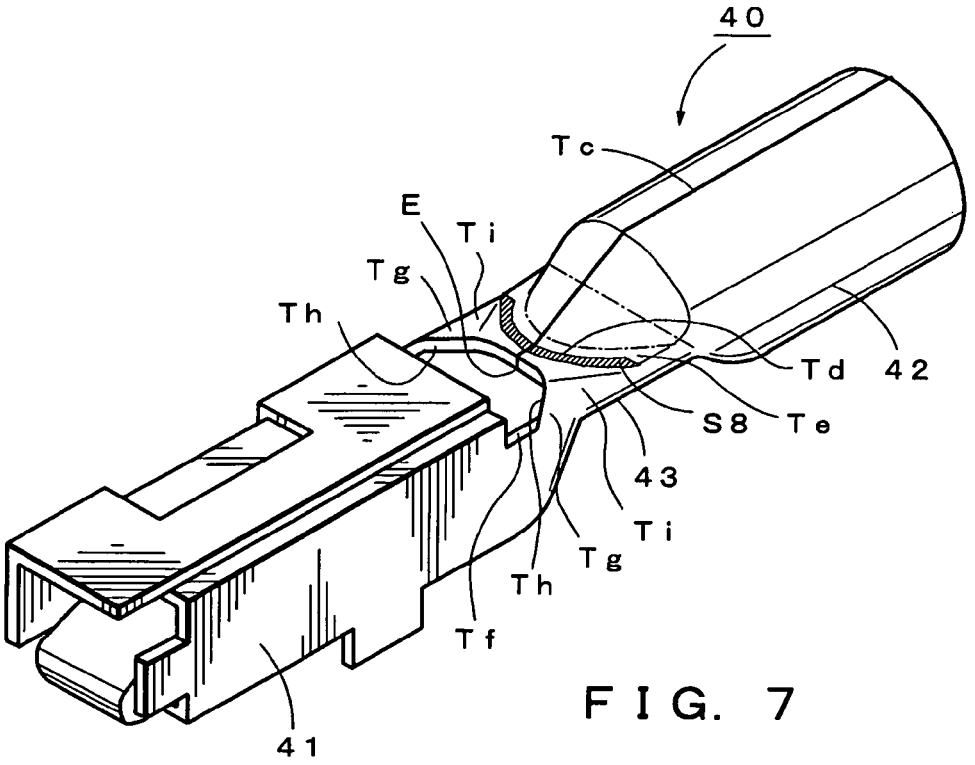
FIG. 7 is a perspective view of a crimp terminal according to an embodiment of the present disclosure.

In a crimp terminal 40 of the fifth embodiment, the shape of the boundary between a connector portion 41 and a transition portion 43 of the crimp terminal 40 is changed, as shown in FIG. 7, as a modification of the crimp terminal 20 or 30 shown in FIGS. 5A, 5B or FIG. 6. The welding trajectory S8 of the crimp terminal 40 is shown by a curve in FIG. 7, but this is a typical embodiment, and the welding trajectory can be also formed according to any of the patterns of the above-described first to third embodiments.

The shape of the boundary between the connector portion 41 and the transition portion 43 in the crimp terminal 40 is changed in two points as described below.

Firstly, a wall portion Tf where a plate material on the connector portion 41 side, with respect to the lapped portion Te, is raised changes from a state in which the plate material stands vertically to a state in which the edge portions of the plate material are abutted, from the connector portion 41 side toward the end portion E of the butted interface Tc, thereby forming a folding back portion Tg. An inclined surface Th of the plate material that forms the folding back portion Tg has gradual inclination from an outer side to an inner side. The folding back portion Tg also forms a hollow space in which the upper and lower plate materials are not brought in close proximity to each other.

Secondly, the lapped portion Te in the transition portion 43 on the connector portion 11 side is formed to rise in a curved manner so as to follow a welding trajectory S8, as shown by a broken line in the figure. In other words, as has been mentioned in the explanation of FIG. 7, when the transition portion 43 and the lapped portion Te are formed by bending, the lapped portion Te on the connector portion 41 side is squeezed in a curved manner and the upper and lower plate materials are brought in close proximity to each other. As a result of such bending, the area of the lapped portion Te which is to be squeezed is reduced, a hollow space is provided between bent plate materials in the transition portion 43, and a bulging portion Ti is formed in which the upper and lower plate materials are not in close contact with each other. The bulging portion Ti is formed to be inclined such that the thickness of the transition portion 43 increases gradually from the lapped portion Te side toward the aforementioned folding back portion Tg.

In the crimp terminal 40 of the above-described fifth embodiment, in the transition portion 43, the range of the lapped portion Te that has been squeezed by bending is reduced, but the hollow folding back portion Tg or the bulging portion Ti is provided between the bent plate materials, thereby making it possible to increase the strength of the transition portion 43. Therefore, the strength of the crimp terminal can be prevented from decreasing locally and the ingress of moisture to the conductor portion of the coated conductive wire can be prevented more adequately as compared to a case where the welding trajectory is formed on a straight line in the left-right direction with respect to the axial direction of the terminal.

3. Other Embodiments

The present disclosure is not limited to the above-described embodiments and is also inclusive, for example, of the following embodiments.

In the above-described embodiments, the laser welding trajectory is formed to extend from one end to the other end in the left-right direction with respect to the axis direction of the crimp terminal in the lapped portion Te of the crimp terminal, but the present disclosure also includes an embodiment in which laser welding is performed only in the central portion, and predetermined ranges from the left and right end portions are not laser welded.

In other words, in the lapped portion Te, the left and right end portions with respect to the axial direction serve as thick portions of the base material that forms the crimp terminal, and a wall portion is formed. This wall portion is not required to be sealed by welding. Therefore, even if the laser welding is implemented outside the thick portions at the left and right end portions, no adverse effect is produced on the hermeticity, whereas since the welding range is narrowed, the decrease in strength caused by the thermal effect of laser welding in the transition portion can be prevented.

Further, in the present disclosure, the cross-sectional shape of the lapped portion Te is not necessarily limited to a flat shape, and a complex cross-sectional shape as shown in FIGS. 9A to 9H and FIGS. 10A to 10C may be also used.

Figure 9A:
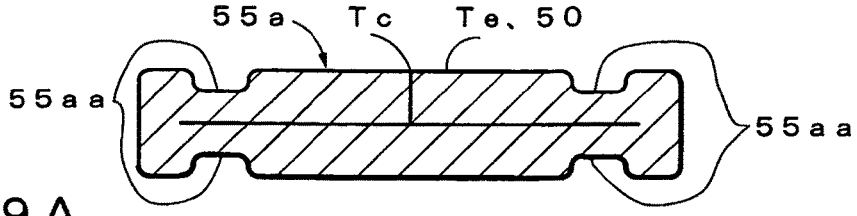
FIGS. 9A to 9H are cross-sectional views of the lapped portion of a crimp terminal according to an embodiment of the present disclosure.
Figure 9B:
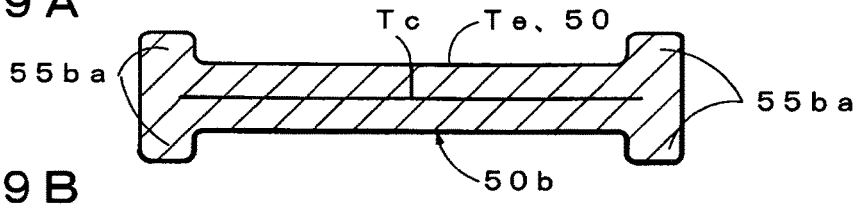
Figure 9C:
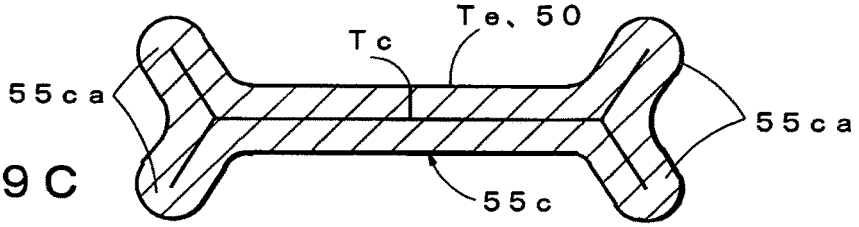
Figure 9D:
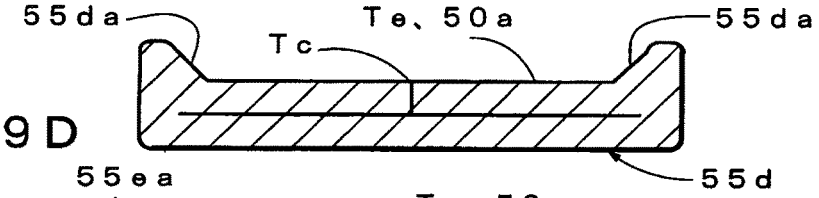
Figure 9E:
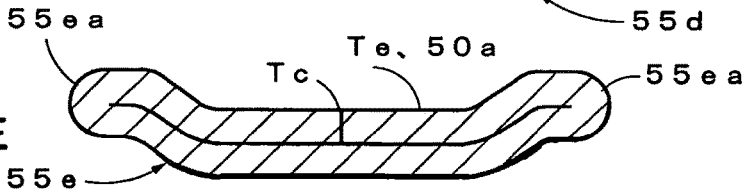
Figure 9F:
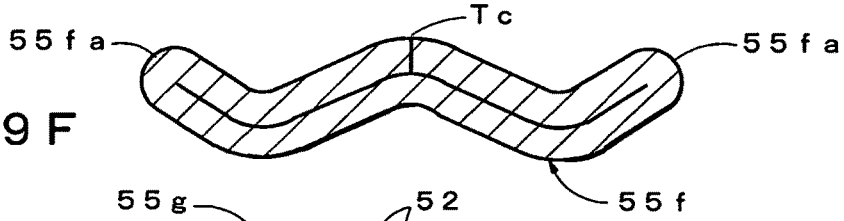
Figure 9G:
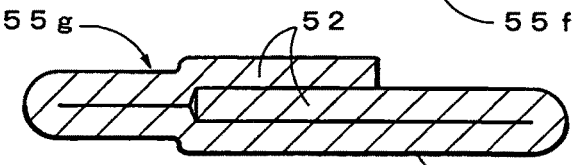
Figure 9H:
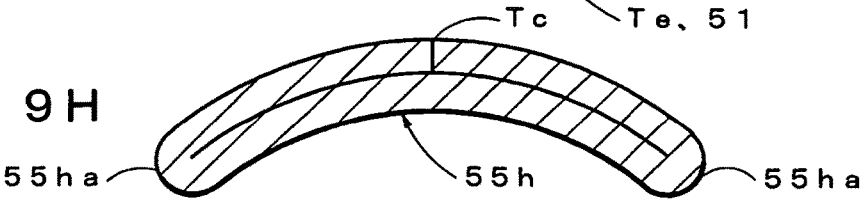

More specifically, in the cross-sectional shape 55*a* shown in FIG. 9A, recessed portions 55*aa* are formed in a surface 50 of the lapped portion Te, for example, by squeezing in the vicinity of the left and right end portions with respect to the axial direction. In the cross-sectional shape 55*b* shown in FIG. 9B, protruding portions 55*ba*, which protrude from the surface 50 of the lapped portion Te, are formed at the left and right end portions with respect to the axial direction. In the cross-sectional shape 55*c* shown in FIG. 9C, protruding portions 55*ba*, which protrude from the surface 50 of the lapped portion Te, are formed outward of the left and right end portions with respect to the axial direction. In the cross-sectional shape 55*d* shown in FIG. 9D, protruding portions 55*bc*, which protrude from the surface 50*a* of the lapped portion Te, in which the butted interface Tc has been formed, are formed at the left and right end portions with respect to the axial direction. In the cross-sectional shape 55*e* shown in FIG. 9E, rising portions 55*ea* where the left and right end portions with respect to the axial direction, are raised are formed with respect to the surface 50*a* of the lapped portion Te in which the butted interface Tc has been formed. The cross-sectional shape 55*f* shown in FIG. 9F is a substantially W-shape in which left and right portions 55*fa*, with respect to the axial direction, and the butted interface Tc of the lapped portion Te are raised. In the cross-sectional shape 55*g* shown in FIG. 9G, an overlapped portion 52 is formed in which a part of the plate 51 corresponding to the lapped portion Te is overlapped and bent. FIG. 9H shows a shape in which the butted interface Tc rises with respect to left and right end portions 55*fa* with respect to the axial direction.

Figure 10A:
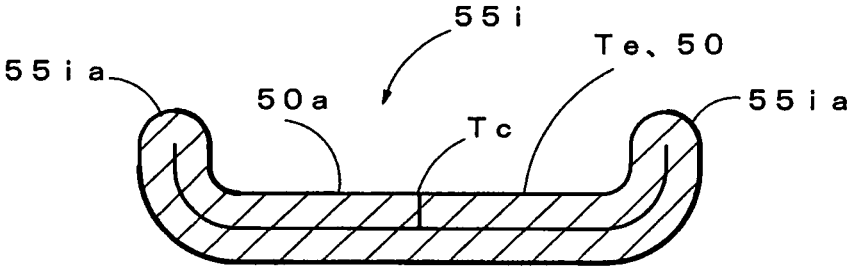
FIGS. 10A to 10C are cross-sectional views of the lapped portion of a crimp terminal according to an embodiment of the present disclosure.
Figure 10B:
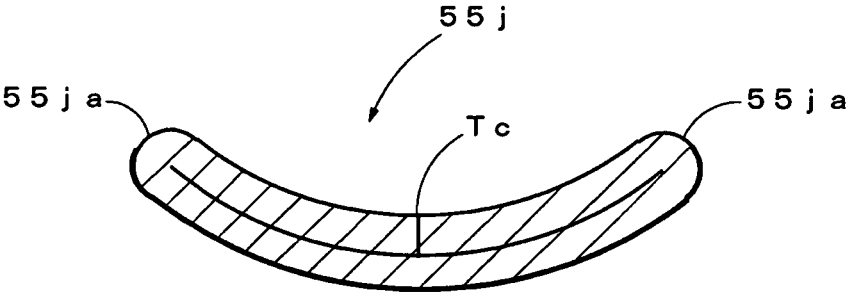
Figure 10C:
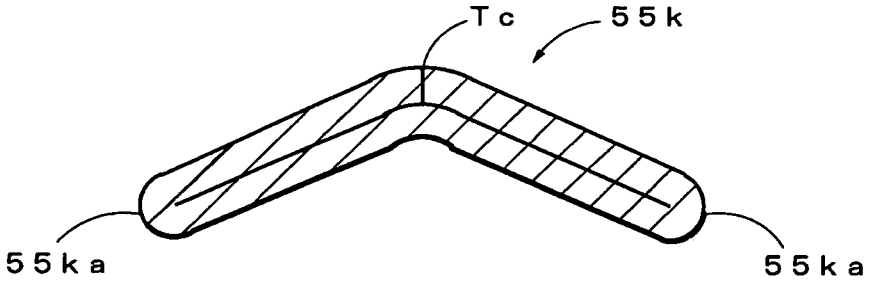

The cross-sectional shape 55*i* shown in FIG. 10A is a substantially U-shape in which rising portions 55*ia* are formed at the left and right end portions with respect to the surface 50*a*, for example, by squeezing the surface 50*a*, on the butted interface Tc side, of the surface 50 of the lapped portion Te. The cross-sectional shape 55*j* shown in FIG. 10B is a substantially U-shape in which rising portions 55*fa* are formed at the left and right end portions with respect to the butted interface Tc, for example, by squeezing the plate material from the abutment side of the lapped portion Te, in the same manner as in the case of the above-described cross-sectional shape 55*i*. The difference between the two above-described cases is that in the cross-sectional shape 55*i*, the circumference of the butted interface Tc is a flat surface (surface 50*a*), whereas in the cross-sectional shape 55*j*, the circumference of the butted interface Tc is raised on the rising portion 55*ja* side, with the butted interface Tc serving as a starting point, instead of being flat. The cross-sectional shape 55*k* shown in FIG. 10C is a substantially V-shape in which the butted interface Tc is raised linearly from the left and right end portions 55*ka*, for example, by squeezing from the surface of the lapped portion Te where the butted interface Tc has not been formed, toward the butted interface Tc side.

With any of the cross-sectional shapes shown in FIGS. 9A to 9H and FIGS. 10A to 10C, by taking a curve, a plurality of straight lines, or a discontinuously formed line as a welding trajectory, it is possible to perform welding to adequately prevent the ingress of moisture to the conductor portion of the coated conductive wire, without locally decreasing in the strength of the crimp terminal.

Further, in accordance with the present disclosure, it is preferred that the welding be started from the positions at a distance equal to the plate thickness from the end portions in the width direction of the lapped portion Te, that is, the left and right end portions with respect to the axial direction. In a case where the welding is started from such positions, a decrease in strength can be suppressed since the end portions are not welded. Further, since the welding is performed from the inner side obtained by bending the plate substantially through 180°, waterproofing can be also ensured.

In accordance with the present disclosure, a decrease in strength caused by the thermal effect of welding can be suppressed by performing welding such that the bead width in the lapped portion Te is as small as possible.

Further, in accordance with the present disclosure, it is preferred that the welding be performed by irradiating the lapped portion Te with a laser beam from the opening portion in the electric wire insertion opening, instead of welding the surface of the lapped portion Te. In other words, a decrease in strength can be suppressed as compared to a case of welding the surface of the lapped portion Te in which penetration welding can occur.

Further, in accordance with the present disclosure, the welding trajectory may be also formed by a single straight line from either of the left and right end portions with respect to the axial direction of the crimp terminal, in the lapped portion Te. In other words, either one among the two welding trajectories shown in FIG. 3D may be formed. Furthermore, in accordance with the present disclosure, in the lapped portion Te, a welding trajectory that exhibits, for example, a checkerboard pattern may be formed in the lapped portion Te. In accordance with the present disclosure, a substantially W-shaped welding trajectory S2 that starts and ends at the left and right end portions with respect to the axial direction of the crimp terminal 10 may be formed in the lapped portion Te.

Figure 11A:
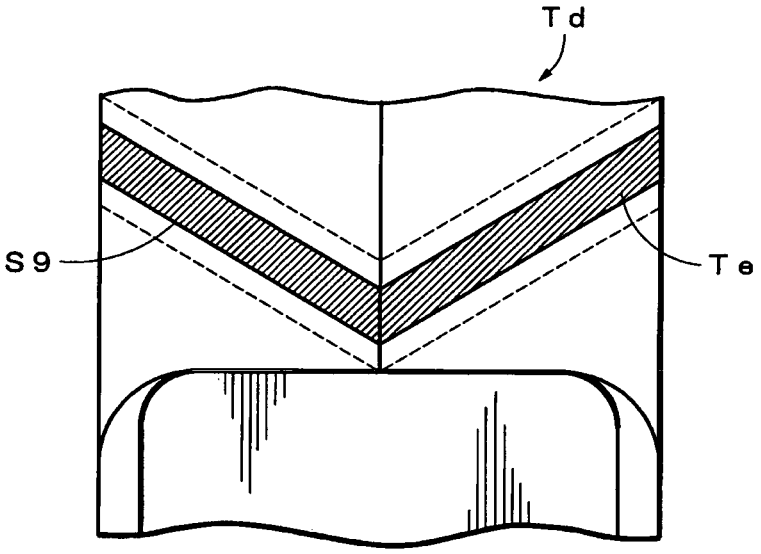
FIGS. 11A and 11B are schematic diagrams showing the welding pattern of a crimp terminal according to an embodiment of the present disclosure.
Figure 11B:
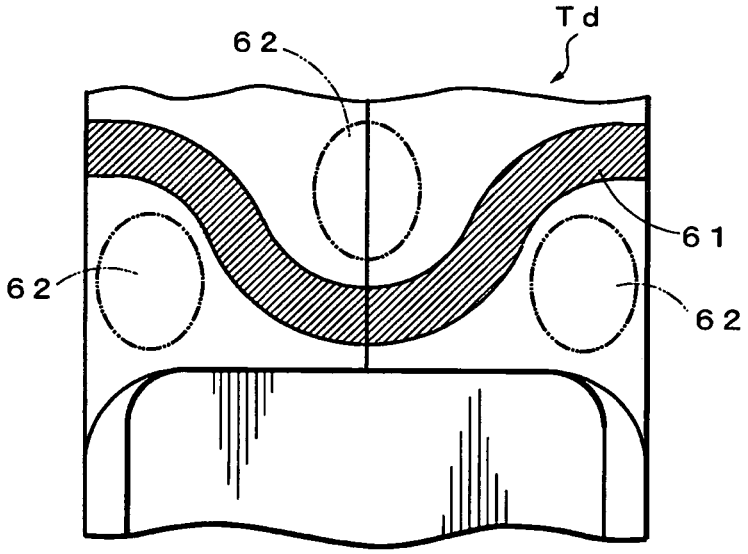

Further, in accordance with the present disclosure, the lapped portion Te may be also formed by squeezing the plate materials and bringing them in close proximity with each other only in the part of the transition portion Td where the welding trajectory is to be formed. For example, in the embodiment in which the above-described welding trajectory is formed in a V-shape by two straight lines, as shown in FIG. 11A, the lapped portion Te may be formed by squeezing the plate materials and bringing them in close proximity to each other only in a broken line portion surrounding a welding trajectory S9. Further, as shown in FIG. 11B, a bulging portion 62 in which the plate material on the circumference of a weld portion 61 is not squeezed but bulged may be formed in a transition portion Td after the welding.

Figure 12A:
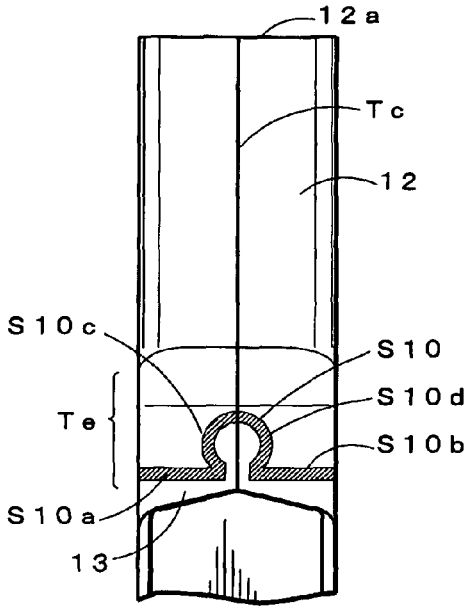
FIGS. 12A to 12B are schematic diagrams showing the welding pattern of a crimp terminal according to an embodiment of the present disclosure.
Figure 12B:
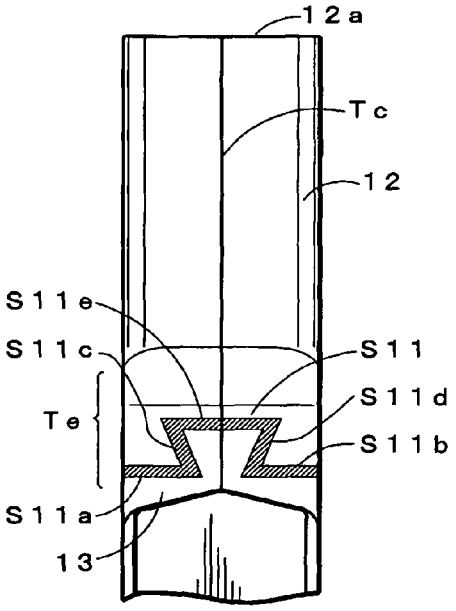
Figure 13:
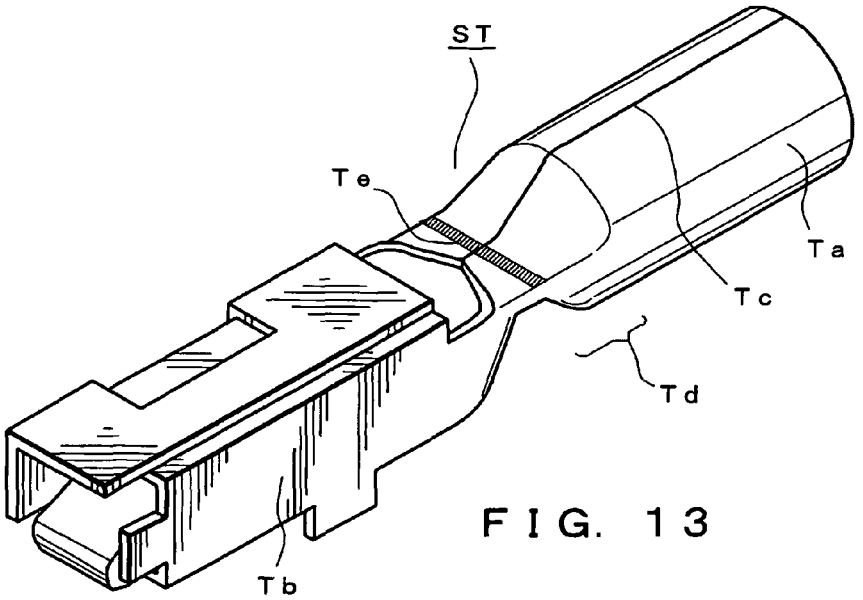
FIG. 13 is a perspective view of the configuration of a crimp terminal of the related art.

Further, in accordance with the present disclosure, a part of the trajectory swept in the direction perpendicular to the axial direction may be turned back along the way, as shown in FIGS. 12A and 12B. In other words, the welding trajectory, such as a welding trajectory S10 shown in FIG. 12A, may be constituted by trajectories S10*a* and S10*b* swept from the left and right end portions, with respect to the axial direction, toward the axial direction to positions very near the butted interface Tc, and trajectories S10*c* and S10*d* that are connected at the butted interface Tc on the opening portion 12*a* side and obtained by turning back the sweeping directions at the distal ends of the trajectory S10*a* and the trajectory 10*b* and sweeping so as to draw semicircles.

The welding trajectory, such as a welding trajectory S11 shown in FIG. 12B, may be also constituted by trajectories S11*a* and S11*b* swept from the left and right end portions with respect to the axial direction, toward the axial direction to positions very near the butted interface Tc, trajectories S11*c* and 11*d* obtained by turning back the sweeping directions at the distal ends of the trajectory S11*a* and the trajectory 11*b* and projecting to the opening portion 12*a* side, and a trajectory S11*e* swept in the direction perpendicular to the axial direction so as to connect the distal ends of the trajectories S11*c* and S11*d*.

In the welding trajectories S10 and S11 shown in FIGS. 12A and 12B, a convex part that projects towards the opening portion 12*a* side is formed at the central portion of the trajectory. The projecting direction of the convex part is not limited to that toward the opening portion 12*a* side, which is shown in FIGS. 12A and 12B, and also includes an embodiment in which the convex part projects in the direction opposite that to the opening portion 12*a*, that is, toward the connector portion 11 side.

In the above-described embodiments, an example is explained in which an aluminum core wire is connected by crimping to a crimp terminal, but the innovation relating to the welding trajectory of the present disclosure is not limited to this example and can be also used in the case of connecting, for example, a copper core wire by crimping to a crimp terminal. Further, in the above-described embodiments, a crimp terminal and a wire harness are explained by way of examples, but the innovation relating to the welding trajectory of the present disclosure is not limited to the crimp terminal and can be also used in the case in which a terminal from a plate material, such as a bus bar, is connected and laser welded.

What is claimed is:

1. A crimp terminal comprising: a crimp portion that includes a plate material bent into a hollow shape, the crimp portion having at one end thereof an opening capable of accommodating and crimping a conductor portion of a coated wire;

a first weld portion obtained by bringing two edge portions of the crimp portion in close proximity to each other and joining by laser welding; and a second weld portion obtained by forming a lapped portion by overlapping of a transition portion formed at an opposite end of the crimp portion to the opening, and closing the lapped portion by laser welding, the second weld portion extending between first and second widthwise end regions of the transition portion in such a manner that the first weld portion intersects or abuts the second weld portion, a welding trajectory in the second weld portion being constituted by a curve, a plurality of straight lines, or a discontinuously formed line, wherein a welding trajectory in the second weld portion is constituted by a plurality of lines, and lines of the plurality of lines cross each other at a position where the two edge portions of the crimp portion are brought in close proximity to each other.

2. The crimp terminal according to claim 1, wherein the welding trajectory formed by a curve has a U-shape.

3. The crimp terminal according to claim 1, wherein the welding trajectory formed by a plurality of straight lines has a V-shape.

4. The crimp terminal according to claim 1, wherein the welding trajectory is formed at a predetermined distance from left and right end portions with respect to an axial direction of the lapped portion.

5. The crimp terminal according to claim 1, wherein a boundary with the transition portion in the crimp portion is formed along a shape of the welding trajectory.

6. The crimp terminal according to claim 1, wherein the transition portion is provided with: a lapped portion in which portions of the plate material are in close contact with each other that is formed along a shape of the welding trajectory; and a hollow portion in which the portions of the plate material are not in close contact with each other.

7. The crimp terminal according to claim 1, comprising a connector portion serving as a connecting terminal, wherein the crimp portion and the connector portion are connected by the transition portion;

at a connecting portion between the connector portion and the transition portion, a folding back portion is formed at which the plate material changes from a state in which the plate material stands vertically to a state in which two edge portions of the plate material are brought in close proximity to each other, in order to form the first weld portion by bending the plate material; and the folding back portion is formed in such a manner that the edge portion of the plate material has a gradual inclination from an outer side to an inner side from the connector portion side toward the end portion of the first weld portion.

8. The crimp terminal according to claim 1, wherein, on left and right end portion sides with respect to the axial direction of the lapped portion, the welding trajectory in the second weld portion is formed from positions at a distance equal to a thickness of the plate material.

9. The crimp terminal according to claim 1, wherein the welding trajectory in the second weld portion is a trajectory of welding performed by irradiating a lapped portion with a laser beam from the opening portion of the crimp portion.

10. A wire harness comprising:

a coated wire in which a conductor portion is exposed at an end from an insulating coating; and a crimp terminal provided with a crimp portion that is formed by bending a plate material into a hollow shape and that has at one end an opening capable of accommodating and crimping the conductor portion of the coated wire, the wire harness further comprising:

a first weld portion obtained by bringing two edge portions of the crimp portion in close proximity to each other and joining by laser welding; and a second weld portion obtained by forming a lapped portion by overlapping of a transition portion formed at an opposite end of the crimp portion to the opening, and closing the lapped portion by laser welding, the second weld portion extending between first and second widthwise end regions of the transition portion in such a manner that the first weld portion intersects or abuts the second weld portion, a welding trajectory in the second weld portion being constituted by a curve, a plurality of straight lines, or a discontinuously formed line, wherein a welding trajectory in the second weld portion is constituted by a plurality of lines, and lines of the plurality of lines cross each other at a position where the two edge portions of the crimp portion are brought in close proximity to each other.

11. The crimp terminal according to claim 1, wherein straight lines of the plurality of straight lines cross each other at a position where the two edge portions of the crimp portion are brought in close proximity to each other.

* * * * *